US005820285A

United States Patent [19]

Ikeda et al.

[11] Patent Number: 5,820,285

[45] Date of Patent: Oct. 13, 1998

[54] PEN NIB

[75] Inventors: Yasuo Ikeda; Toshihiro Ono, both of Hiratsuka, Japan

[73] Assignee: Kabsuhiki Kaisha Pilot, Tokyo-To, Japan

[21] Appl. No.: 817,775

[22] PCT Filed: Aug. 16, 1996

[86] PCT No.: PCT/JP96/02307

§ 371 Date: Apr. 24, 1997

§ 102(e) Date: Apr. 24, 1997

[87] PCT Pub. No.: WO97/07989

PCT Pub. Date: Mar. 6, 1997

[30] Foreign Application Priority Data

Aug. 24, 1995 [JP] Japan ..... 7-239193

[51] Int. Cl.[6] ..... B43K 5/00

[52] U.S. Cl. ..... 401/199; 401/266

[58] Field of Search ..... 401/199, 196, 401/264, 266, 261, 267

[56] References Cited

U.S. PATENT DOCUMENTS 3,843,270 10/1974 Kiriu et al. ..... 401/199

4,824,271 4/1989 Nagahama et al. ..... 401/266

4,973,182 11/1990 Nakano ..... 401/199

5,388,924 2/1995 Chao ..... 401/199

*Primary Examiner*—David J. Walczak

*Attorney, Agent, or Firm*—Wenderoth, Lind & Ponack, L.L.P.

[57] ABSTRACT

An ink passage (6) including a shallow groove (6*a*) having the shape of a thin film and forming a very small gap capable of exercising capillarity and deep grooves (6*b*) of a depth greater than that of the shallow groove (6*a*), is formed in a joining surface (5) of a pen nib formed by putting a pair of nib elements (1*a*, 1*b*) together in a face-to-face disposition and by fixing rear portions of the nib elements to a neck tube (2) or the like of a pen barrel. Front portions, i.e., nonfixed portions, of the pair of nib elements (1*a*, 1*b*) are formed in elastically deformable shapes so that the front portions are able to slide relative to each other when writing force is applied to the tip of the nib. The pen nib is capable of giving a writing touch similar to that given by a fountain pen provided with a metal nib, of supplying a sufficient quantity of ink to the tip thereof, of writing "smoothly" under low writing force both when moved "slowly" and when moved "quickly" and of giving a weak feeling of the resistance of the paper sheet. The nib rarely suffers from insufficient flow of ink due to dry residues of ink accumulated in the ink passage.

20 Claims, 9 Drawing Sheets

PEN NIB

TECHNICAL FIELD

The present invention relates to a pen nib having two nib elements put together and suitable particularly for calligraphy.

BACKGROUND ART

Trials have been made to form a synthetic resin pen nib which replaces a metal pen nib. A synthetic resin nib is inferior in durability to a metal nib of the same construction. Ballpoint pens for writing relatively thin lines, having no writing directionality have widely been used, and there have been only a few types of writing implements capable of drawing thick lines. There has been commercialized a fiber bundle pen capable of drawing thick lines with a light touch and characterized in compensating for low durability by reducing bearing stress induced by writing force.

Methods of forming wide synthetic resin pen nibs for calligraphy are proposed in JP-U Nos. 63-41183 and 2-28068 and JP-A No. 7-149092. These previously proposed methods weld together synthetic fibers gathered in a bundle so as to form appropriate capillaries which serve as ink passages in its cross section or grind an extruded workpiece having capillaries in its cross section to provide a pen nib having a thin tip. Each of pen nibs disclosed in those references is an aggregate of tubular bodies of various sectional shapes and is constructed so as to prevent the evaporation of the components of ink from its outer surface.

Since the tip portions of the known pen nibs are ground to form thin tips and are subjected to post-processes including a slitting process, it has been difficult to secure dimensional accuracy after processing.

A tubular nib is bent naturally when writing force is applied to the tip of the nib and, consequently, the internal capillaries (ink passages) are partly deformed. Since a nib of this kind is made by forming an elongate material of a substantially uniform cross section, the capillaries cannot be so formed that the capillaries in a nib portion near the tip of the same and the capillaries in a proximal portion of the nib near the ink reservoir are different in capillarity. Therefore, the surface tension of ink to be used by such a nib must be low in order that the ink is able to flow smoothly through the nib, and hence the spread of the ink permeating a paper sheet must be suppressed to the least extent by reducing the quantity of the ink transferred to the paper sheet. Since the quantity of the ink transferred to the paper sheet is small, the color density of the ink must be increased to enhance contrast and the color component concentration of the ink must be increased. Accordingly, the quantity of residues which remain in a tip portion of the nib after the evaporation of the evaporative components of the ink increases, and the writing performance of the pen is not satisfactory at the beginning of writing after the pen has been left unused.

Efforts must be exerted to control the components of the ink so that the ink has balanced quality to solve such problems. Since the viscosity of the ink increases as a natural consequence, the capillaries need to be expanded in the cross section and, if the sectional shape of the nib is caused to change greatly by the writing force, i.e., if the nib is very flexible, the ink is liable to flow irregularly. In order to avoid this, known pen nibs of this kind have a relatively low flexibility and give a relatively hard touch.

Since the fiber bundle nib is easily deformable, only a portion of the fiber bundle nib in contact with a paper sheet is deformed and capillaries in the same portion are deformed. Therefore, the flow of the ink is liable to vary and it is difficult to bring the tip portion of the nib into uniform contact with a writing surface. The sectional shape of a fiber bundle nib provided with a slit in its tip portion, such as disclosed in JP-U No. 2-28068, changes when writing force is applied to the fiber bundle nib, and the nib scatters the ink and vibrates to make writing difficult because a tooth-shaped portion in which the slit is formed engages with and disengages from a through hole when the nib is moved in a specific direction.

As mentioned above, the capability of capillaries formed in a fiber bundle to transfer a relatively small quantity of the ink to the paper sheet is a significant feature which produces a characteristic writing touch, such as a creaking touch and a rough touch. Since the fiber bundle nib is not very elastic, the nib is able to assume a state in which the tip thereof is pressed against the paper sheet by writing force or a state in which the tip of the nib is separated from the paper sheet upon the reduction of pen force. Thus, the fiber bundle nib gives only a binary writing touch.

The inventors of the present invention examined various properties of pen nibs with an intention to provide a nib capable of giving a writing touch similar to that given by a fountain pen provided with a metal nib, having large ink passages capable of transferring a sufficient quantity of ink to a paper sheet to write letters in a "full hand" even if the ink has a high surface tension, and capable of supplying a sufficient quantity of the ink to the tip thereof to lubricate the same so that the nib is able to write "smoothly" with low writing force both when moved "slowly" and when moved "quickly" and of giving a weak feeling of the resistance of the paper sheet, and have found that an optimum pen nib has a structure formed by joining together two nib elements face to face.

Nibs of a configuration formed by putting together two nib elements face to face are proposed in JP-U Nos. 57-149170 and 60-80975. These previously proposed pen nibs were examined. The former cited reference proposes a nib provided with an ink passage formed in its center. This nib is formed by putting together two synthetic resin nib elements, and an ink passage is formed in the center of the nib integrally or separately. Also disclosed in the former cited reference is a slit formed in a tip portion of the nib so as to communicate with the ink passage. The latter cited reference proposes a nib formed by laminating a plurality of thin plate-shaped members. In this nib, a plurality of ridges are formed on at least one of contiguous surfaces so as to extend between a base end to a tip, and a plurality of grooves complementary to the ridges are formed in the other surface to form ink passages between the corresponding surfaces of the ridges and the grooves.

When putting together the two plate-shaped nib elements of those nibs, the nib elements are joined together by adhesion, welding or a strong fixing method so that any gap is not formed between the nib elements. The two nib elements thus firmly joined together are deformed elastically like a single structure under writing force, and the nib is relatively rigid. Therefore, the nib according to a device proposed in the latter cited reference is formed in a very small thickness in the range of about 0.1 to about 0.6 mm.

The inventors of the present invention found that, although the ink evaporates through the contiguous surfaces of the nib elements in the structure formed simply by putting together the two nib elements and residuals remaining after the evaporation of the ink clog the ink passages, the two nib elements need not be fixedly joined together and an elastic nib of a construction having a relatively great thickness can be obtained if a method capable of easily removing the residuals by the writing action of the nib (pumping action). The inventors of the present invention further found, through the examination of the mode of elastic deformation of the two nib elements and the mode of variation of the ink passages formed in the contiguous surfaces under writing force, that the dry residuals are broken apart or dissolved again when the nib is used for writing and the nib is restored to its writing condition even if the ink has dried while the nib has been left exposed and the nib has become a state in which the ink is unable to flow, provided that the two nib elements are able to slide relative to each other in a mode which will not break the ink passages, and have made the present invention.

The present invention has been made in view of those facts and it is therefore an object of the present invention to provide a pen nib capable of giving a writing touch similar to that given by a fountain pen provided with a metal nib, having large ink passages capable of transferring a sufficient quantity of ink to a paper sheet to write letters in a "full hand" even if the ink has a high surface tension, and capable of supplying a sufficient quantity of the ink to the tip thereof to lubricate the same so that the nib is able to write "smoothly" with low writing force both when moved "slowly" and when moved "quickly" and of giving a weak feeling of the resistance of the paper sheet.

Another object of the present invention is to provide an inexpensive, high-performance pen nib capable of reducing a possibility of an ink passage being clogged with dry residues remaining after the evaporative components of the ink supplied to the ink passage have evaporated and of maintaining an ability to form a clear-cut hand for a long period of use, and having an ink supply mechanism capable of coping with necessity to supply a sufficient quantity of the ink for writing thick lines.

DISCLOSURE OF THE INVENTION

To achieve the foregoing objects, the present invention provides a pen nib comprising a pair of nib elements each having a flat front portion having the shape of a flat plate, and a rear portion extending from the front portion. The nib elements have flat inner surfaces, respectively, the rear portions of the nib elements are fixedly joined together with their flat surfaces, i.e., joining surfaces, in surface contact with each other, an ink passage is formed in at least one of the opposite inner surfaces of the nib elements through the entire length of the inner surface corresponding to the front portion and the rear portion. The ink passage includes a shallow groove of the shape of a thin film, and deep grooves having a depth greater than that of the shallow groove and formed along and so as to be connected to the shallow groove. The end surface to be brought into contact with a paper sheet of each of the flat front portions of the pair of nib elements has long sides and short sides, and edges are formed along the long sides, slits connected to the ink passage are formed across the edges, and ink is supplied through the ink passage to the slits, whereby the flat front portions slide relative to each other for elastic deformation when writing force is applied to the tip of the nib for writing.

Since the two nib elements of the pen nib of the present invention slide relative to each other when writing force is applied thereto for writing and ink is supplied from an ink reservoir to the tip portion of the nib by the capillarity of the ink passage. The capillarity of the ink passage would be nullified, the ink would not be supplied to the tip portion of the nib and any writing would not be performed if the two nib elements were separated beyond a certain extent. It is therefore desirable to provide the nonfixed portion of the tip portion of the nib with a restraining means which restrains the two nib elements from separating from each other beyond an extent above which an ink film formed between the two nib elements is broken and allows the two nib elements to slide relative to each other.

In a writing implement using watercolor ink, the tip of the nib is brimmed with the ink if the ink is forced out of the ink reservoir of the writing implement by an increased internal pressure of the ink tank. Particularly, the tip of the nib is brimmed remarkably with the ink, the amount of the ink transferred to a paper sheet increases suddenly and small letters and minute expressions are smeared with an excessive amount of ink and become illegible. Such a problem can be prevented by storing excessive ink forced out of the ink reservoir in an appropriate storage. Usually, a structure designed to supply a large quantity of ink from an ink reservoir to a nib is provided with a feed tube provided with an ink collector having comblike grooves. The pen nib of the present invention may be provided integrally with an ink collector having comblike grooves in the outer surface of one of the two nib elements or the outer surface of each of the two nib elements. When the ink collector is formed integrally with the outer surface of one of or each of the two nib elements, a surplus thickness is removed, the capacity of the comblike grooves of the ink collector can be increased, the writing implement provided with the nib can be assembled in a simple construction, the number of parts can be reduced and the cost can be reduced. If the pen nib is formed by a double-shot molding process which forms a body by injection-molding an abrasion-resistant synthetic resin and combining a portion of a synthetic resin having excellent ink characteristic with the body, the nib can be formed in a thickness smaller than that of a nib formed by combining two parts.

A mechanism for forcibly returning ink into the comblike grooves of the ink collector by the agency of the surface tension of an ink droplet formed on the tip of the nib to return the ink into the comblike grooves of the ink collector formed integrally with the feed tube or the nib as quickly as possible upon the brimming of the nib with ink. Connecting grooves which connects the comblike grooves to the ink passage may be formed in the joining surfaces of the nib elements in which the main ink passage is formed. The ink can be returned through the shortest passage to the comblike grooves of the ink collector.

In a writing implement which, in most cases, is put in a pocket of clothes with the nib directed upward, the capillarity of a front end portion of the ink passage of the nib must be higher than that of a rear end portion of the ink passage on the side of the ink reservoir. Such a requirement can be met by forming the groove having the shape of a thin film so that the depth of a portion nearer to the tip of the nib is smaller than that of a portion of farther from the tip of the nib.

It is a necessary condition for a writing implement that ink is kept on the tip of the nib in a state where the nib is directed upward. Therefore, the capillarity of even a portion of the front portion of the nib must not be low, because if the flow of ink in the portion having a reduced capillarity is stopped the portion of the ink passage dries up and ink is unable to flow smoothly through the dried portion of the ink passage when the writing implement is used for writing. If deep grooves or slits forming capillaries were formed symmetrically with respect to the boundary plane between the two nib elements, intersection including the shallow groove having the shape of a film having a cross-shaped cross section would be formed and the width of portions of the capillaries corresponding to the intersections would be increased, thus locally reducing the capillarity of the capillaries. Such a problem can be avoided by forming the deep grooves and the slits asymmetrically with respect to the joining surface.

The slits formed in the front end portion of the pen nib are able to transfer ink to a paper sheet even if the nib is put to the paper sheet in an inclined position slanted at a small angle to the paper sheet. A sufficient quantity of ink can be transferred to the paper sheet regardless of the direction of movement of the nib, when slits are formed in a paper sheet contact portion of the nib substantially in parallel to the joining surfaces so as to communicate with the ink passage formed in the joining surfaces of the two nib elements. If the slits have a short length, such as about 0.05 mm, the quantity of ink that can be transferred to a paper sheet is limited to a very small quantity. If any slit is not formed, ink will not be transferred at all to a paper sheet when the nib is moved in some directions.

There is no particular restriction on the number of slits. When the number of the slits is greater than that of the deep grooves formed in the rear portion of the nib, ink may be supplied through the shallow groove to the slits not corresponding to the deep grooves formed in the rear portion of the nib, to supply ink smoothly to all the slits.

If the width of the shallow groove having the shape of a thin film and opening into the contact portion is too narrow, ink cannot smoothly be supplied to the tip of the nib and an insufficient quantity of ink is transferred to a paper sheet when the pen nib of the present invention is put to the paper sheet for writing with their joining surfaces perpendicular to the surface of the paper sheet. Therefore, the depth and the width of part of the shallow groove formed in the inner surface of the nib element must be increased to transfer an optimum quantity of ink to the paper sheet. Such a requirement can be met by forming an auxiliary groove of a fixed length in the inner surface of one of or each of the two nib elements.

The color of the ink which flows through the ink passage formed in the inner surface of the nib is the same as that of the ink contained in the ink reservoir. Usually, the ink must be changed if ink of another color needs to be used. If a second ink passage capable of exercising capillarity is formed so as to be connected to the slits formed in the tip of the nib in the outer side surface of a nonfixed portion of one or each of the two nib elements, and second ink of a color different from that of the first ink contained in the ink reservoir is supplied to the second ink passage with another writing implement or a pipette, the second ink and the first ink are mixed in the tip of the nib and hence writing of a mixed color can easily be formed. If a plurality of second ink passages are formed and a plurality of kinds of ink having different colors are supplied to the plurality of second ink passages, the opposite end portions of a line are colored in different mixed colors, respectively, to form lines of colors different from those formed by the conventional writing implements.

BEST MODE FOR CARRYING OUT THE INVENTION

Figure 1:
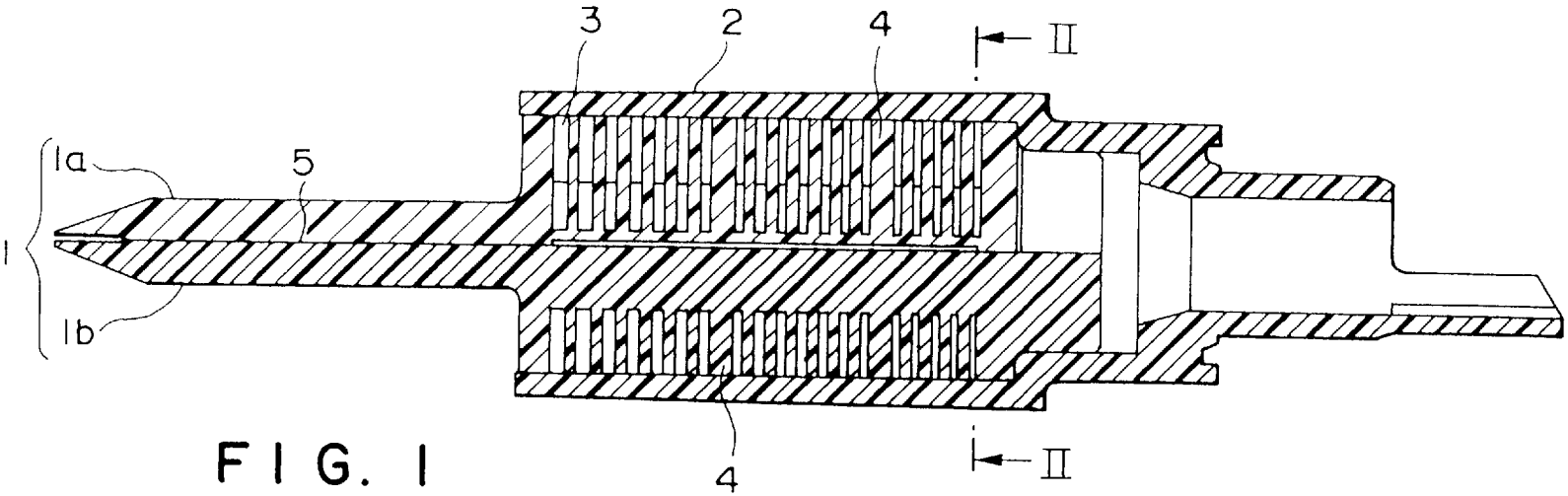
FIG. 1 is a longitudinal sectional view of a pen nib according to a first embodiment of the present invention as fitted in a neck tube.

Preferred embodiments of the present invention will be described with reference to the accompanying drawings. It is to be noted that the present invention is not limited to those embodiments. In the following preferred embodiments, like members and like parts are designated by the same reference characters.

A pen nib according to a first embodiment will be described with reference to FIGS. 1 to 9. FIG. 1 is a longitudinal sectional view of a pen nib 1 with its rear portion fitted in a neck tube 2. The nib 1 has a writing front end portion consisting of a pen nib elements 1*a* and 1*b*. The pen nib elements 1*a* and 1*b* are put together with their opposite flat surfaces 5 in contact with each other. The front portions of the nib elements 1*a* and 1*b* have the shape of a flat plate. The pair of nib elements have rear portions which are expanded and provided integrally with ink collectors 4 provided with comblike grooves 3 for storing surplus ink, respectively. The pen nib 1 is made of a resin, such as a polyacetal resin, has a simple construction and is capable of being manufactured at low cost.

Figure 2:
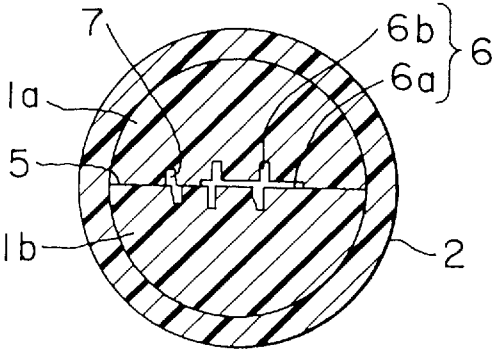
FIG. 2 is a sectional view taken on line II—II in FIG. 1.

FIG. 2 is a sectional view taken on line II—II in FIG. 1. An ink passage 6 is formed at least in one of the nib elements 1*a* and 1*b*, for example, in the joining surface 5 of the nib element 1*a*. The ink passage 6 has an elongate, shallow groove 6*a* having the shape of a thin film extending along the joining surface 5, and deep grooves 6*b* of a depth greater than that of the shallow groove 6*a* and a width smaller than that of the shallow groove 6*a*. The longitudinally rear end portion of the shallow groove 6*a* and/or the longitudinally rear end portions of the deep grooves 6*b* open into an ink reservoir of the pen body, not shown. The grooves 6*a* and 6*b* are formed so that any intersections having a cross-shaped cross section are not formed to prevent local weakening of the capillary force, and the grooves 6*a* and 6*b* are formed asymmetrically with respect to the joining surfaces 5. The nib elements 1*a* and 1*b* are provided with air grooves 7 to supply air into the ink reservoir, not shown. The air grooves 7 extend from portions of the nib elements 1*a* and 1*b* near their tips to portions of the same on the side of the ink reservoir, not shown.

Figure 3:
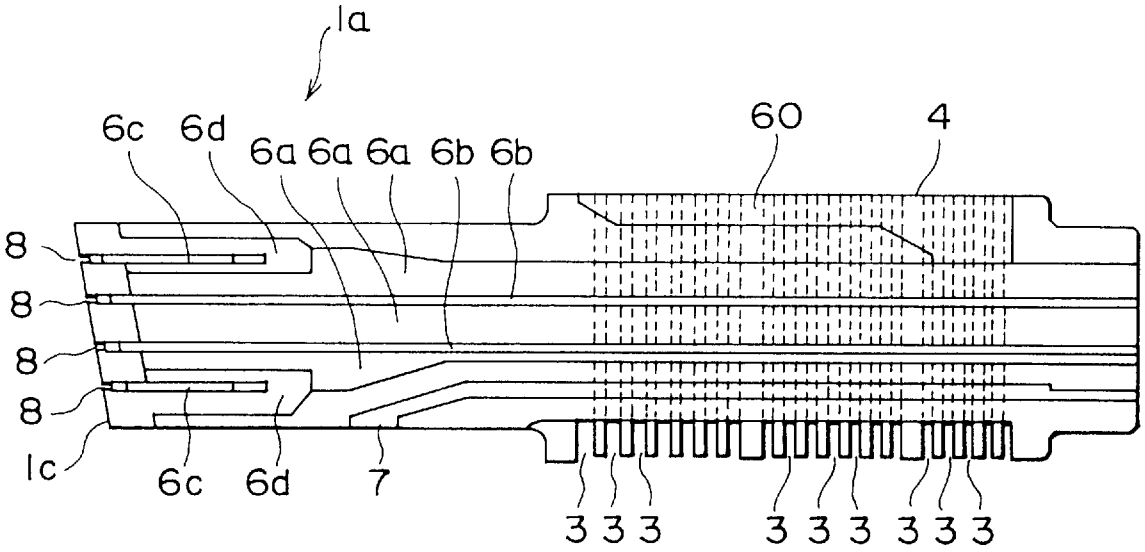
FIG. 3 is a side view of an inner surface of one of pen nib elements of the nib of FIG. 1.

FIG. 3 shows an inner surface of the nib element 1*a* of the pen nib 1 of the present invention. The front end portion of the shallow groove 6*a* having the shape of a thin film and/or the front end portions of the deep grooves 6*b* extend toward the tip, and the grooves 6*a* or the grooves 6*b*, or both the grooves 6*a* and 6*b* open into slits 8 formed in a tip portion 1*c*. The tip portion 1*c* is formed obliquely as shown in FIG. 3. The slits 8 are formed in a paper sheet contact portion of the tip portion 1*c*, and the width of the slits 8 is equal to or smaller than the width of the deep grooves 6*b* serving as capillaries. The size of the slits 8 are determined so that the capillarity increases toward the tip. Connecting grooves 60 are formed in a rear portion of the nib element 1*a* so as to connect the comblike grooves 3 to the shallow groove 6*a* to guide ink overflowing the comblike grooves 3. The connecting grooves 60 are formed between the nib elements 1*a* and 1*b* in a width of 0.1 mm or below so that the connecting grooves 60 are always filled up with the ink.

Figure 4:
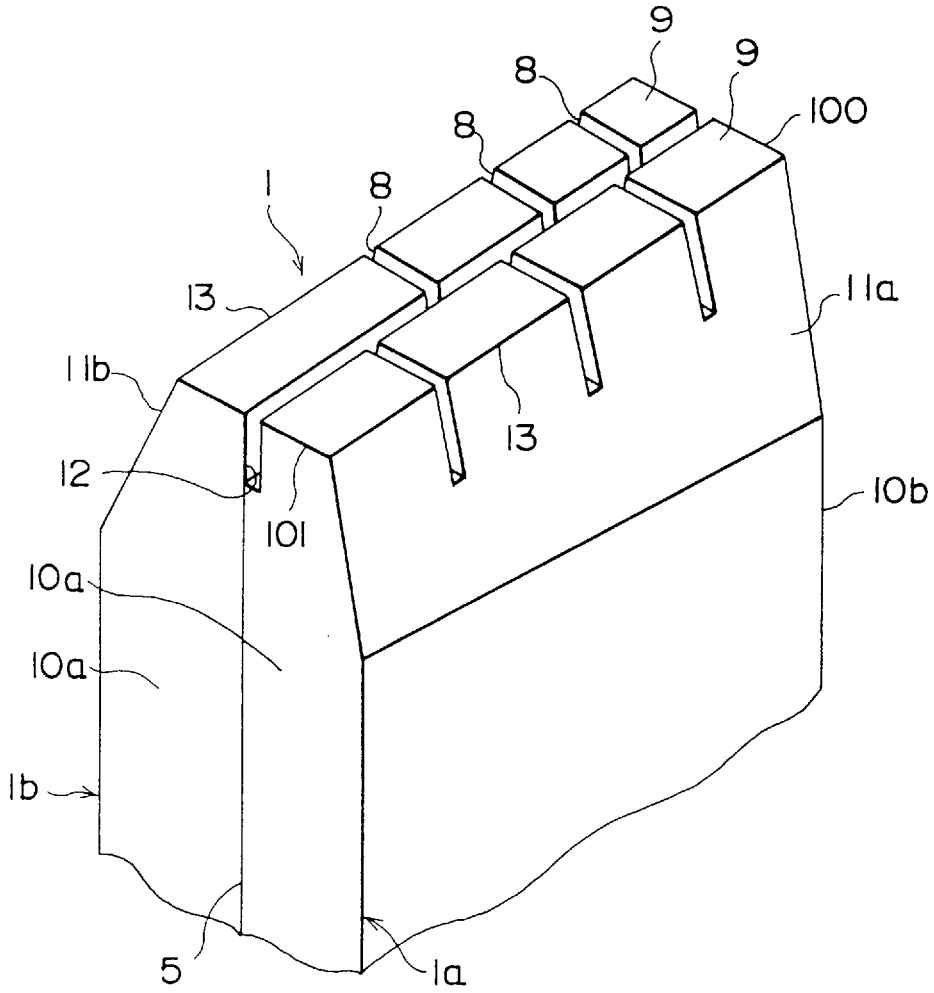
FIG. 4 is an enlarged perspective view of a tip portion of the pen nib of FIG. 1.

FIG. 4 is an enlarged perspective view of a tip portion of the pen nib. The tip portion, i.e., a paper sheet contact portion, has front end surfaces 9 of the nib elements 1*a* and 1*b* forming the oblique tip portion 1*c*, two tip side surfaces 10*a* and 10*b*, and two tip inclined surfaces 11*a* and 11*b*. During writing, one of the two separate surfaces or the edge 13 between the adjacent surfaces is brought into sliding contact with a paper sheet to transfer ink to the paper sheet. The slits 8 are formed in the tip of the pen nib 1 so as to extend in front end surfaces 9 and the inclined surface 11*a* across the edge 13 and/or in the front end surface 9 and the inclined surface 11*b* across the edge 13. If necessary, a joining surface slit 12 is formed in a portion of the joining surface 5 appearing in the tip side surface 10*a* or 10*b*. The joining surface slit 12 may be extended from the joining surface 5 to the tip side surfaces 10*a* and 10*b*.

Figure 5:
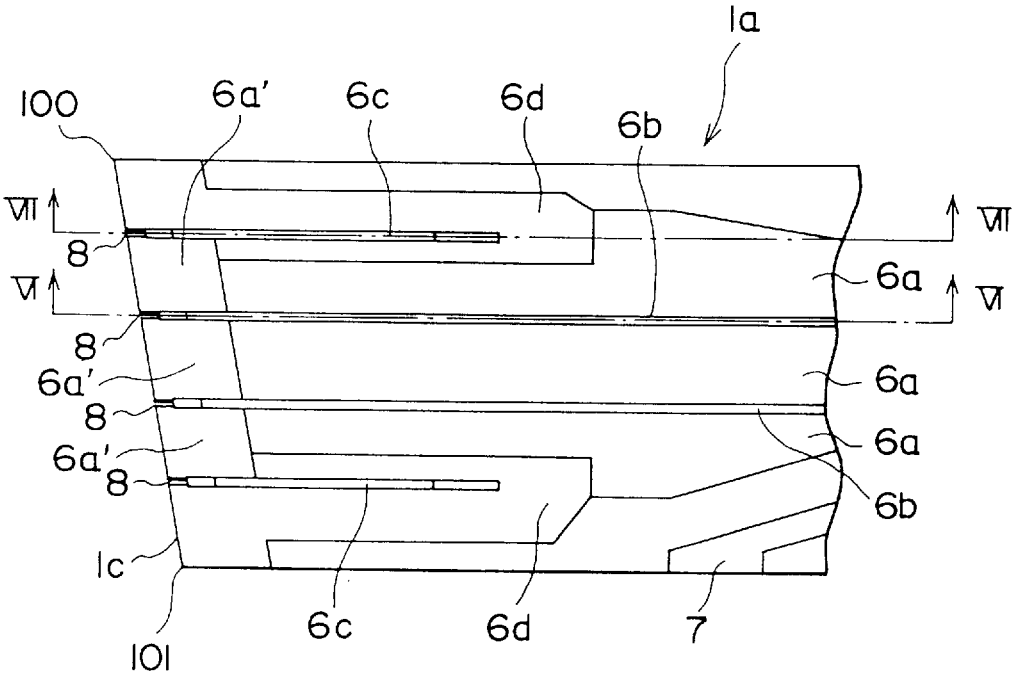
FIG. 5 is an enlarged side view of an inner surface of a tip portion of the pen nib element shown in FIG. 3.
Figure 6:
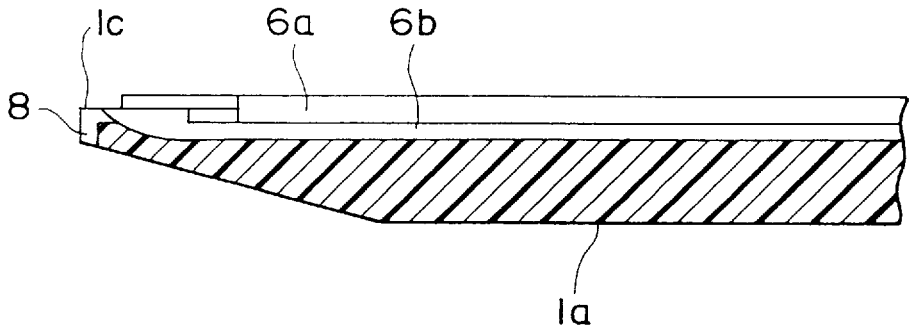
FIG. 6 is a sectional view taken on line VI—VI in FIG. 5.
Figure 7:
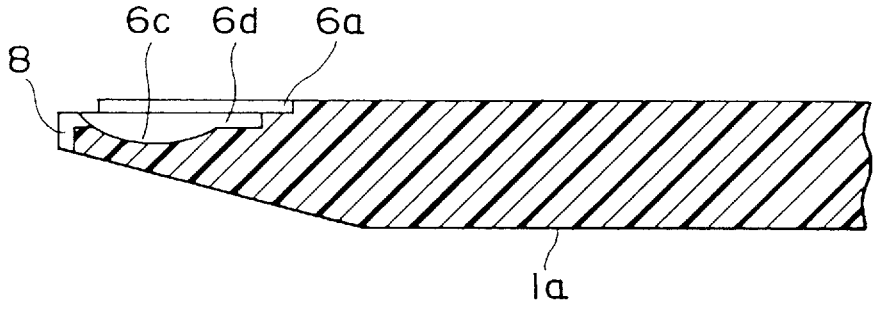
FIG. 7 is a sectional view taken on line VII—VII in FIG. 5.

FIG. 5 is an enlarged view of a tip portion of the nib element 1*a* and FIGS. 6 and 7 are sectional views taken on lines VI—VI and VII—VII, respectively, in FIG. 5. Referring to FIG. 5, the joining surface slit 12 (FIG. 4) is composed of a groove 6*a*' having the shape of a thin film. The joining surface slit 12 is connected to at least one of the shallow groove 6*a* having the shape of a thin film and/or the deep grooves 6*b*.

In this embodiment, the depth of the shallow groove 6*a* may be decreased toward the tip portion 1*c*. Portions of the shallow groove 6*a* contiguous with the tip portion 1*c* are formed in a depth smaller than that of other portions of the shallow groove 6*a* to form the shallow grooves 6*a*' shallower than the shallow groove 6*a* to form portions having a capillarity higher than that of the shallow portion 6*a*. These grooves 6*a*' makes the joining surface slit 12 (FIG. 4) a continuous capillary. Since it is difficult to supply a sufficient quantity of ink to the opposite end portions of the tip portion 1*c* serving as a paper sheet contact surface and having long sides and short sides only through the deep grooves 6*b*, at least one auxiliary groove 6*c* is formed in the inner surface of the nib element 1*a*. A portion of the auxiliary groove 6*c* near the tip portion 1*c*, similarly to the shallow groove 6*a* and/or the deep groove 6*b*, is connected to the slit 8. The auxiliary groove 6*c* is not as long as the deep grooves 6*b* reaching the ink reservoir (not shown) and the other end of the auxiliary groove 6*c* is connected to the shallow groove 6*a* (see FIGS. 5 and 7) and the depth is increased gradually so that ink is able to flow smoothly into the auxiliary groove 6*c* under capillary action.

Suppose that an edge 100 or 101 shown in FIG. 5, corresponding to the short side of the tip surface is put in contact with a paper sheet for writing. Ink flows from the ink reservoir (not shown) through the deep grooves 6*b* and/or the shallow groove 6*a* into the auxiliary groove 6*c*, and the ink flows further through the joining surface slit 12 (FIG. 4) to the edge 100 or 101. The ink flows also through shallow connecting grooves 6*d* connected to the joining surface slit 12 (FIG. 4) to the edge 100 or 101. The greater the distance between the auxiliary groove 6*c* and the deep groove 6*b*, the greater the necessity of the shallow connecting grooves 6*d*. When the inclined surface 11*a* or 11*b* (FIG. 4) of the tip portion 1*c* is put to a paper sheet to draw a thick line, the ink flowing from the ink reservoir (not shown) through the deep grooves 6*b* spreads uniformly in the area from the edge 100 to the edge 101. When drawing a line of a width a (or width b), the edge 100 (or 101) is applied to the paper sheet. In this case, the line can be drawn by supplying ink at a flow rate far lower than the ink supply capacity of the long, deep grooves 6*b*. As the ink is consumed the interior pressure of the ink reservoir (not shown) decreases and, upon the entrance of air bubbles of a quantity corresponding to the quantity of the used ink into the ink reservoir, the internal pressure of the ink reservoir (not shown) increases suddenly and ink pressure at the edge 100 (or 101) increases accordingly. Consequently, the quantity of ink being transferred to the paper sheet increases suddenly and an excessive quantity of ink is transferred to the paper sheet.

Since the edge 100 (or 101) corresponding to the short side consumes ink at a low ink consuming rate per unit of time, air bubbles corresponding to an ink consumption enter the ink reservoir (not shown) at a long cycle time. Therefore, the resistance against the outflow of ink from the ink reservoir (not shown) increases gradually from the precedent time when air bubbles first enter the ink reservoir (not shown) toward the succeeding time when air bubbles first enter the ink reservoir (not shown), and the writing density decreases gradually. It is necessary to exert a resistance against the flow of ink by guiding a large quantity of ink that flows when air bubbles enter the ink reservoir through a very thin passage to the slits 8 to make the writing density uniform during the ink consumption cycle. The depth of the shallow groove 6*a* is decreased toward the tip of the nib and the shallow connecting grooves 6*d* are formed on the outer sides of the outer deep grooves 6*b* to make the capillarity of a portion of the ink passage 6 nearer to the tip of the nib is greater than that of a portion of the same nearer to the ink reservoir (not shown).

Figure 8:
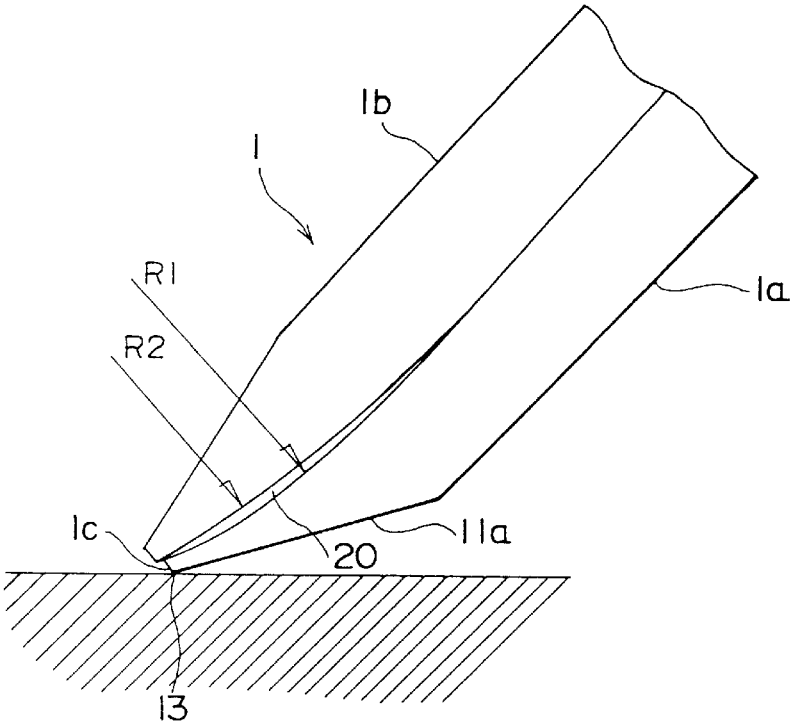
FIG. 8 is a view explanatory of a mode of drawing a thick line by using an oblique surface of a tip portion of a pen nib.

The operation of the nib will be described below. FIG. 8 shows the nib in a state for drawing a thick line with the inclined surface 11*a* or 11*b* (FIG. 4). When writing force is applied in the direction of the width of the nib, the nib is bent. If a paper sheet contact part of the tip portion 1*c* (the edge 13 along which the inclined surfaces 11*a* or 11*b* and the front end surface 9 intersect) is applied to a paper sheet for writing, the nib element 1*a* on the lower side and the nib element 1*b* on the upper side move relative to each other and a small gap 20 is formed between the joining surfaces of the nib elements 1*a* and 1*b*. The radius R2 of curvature of the joining surface of the nib element 1*b* on the upper side is greater than the radius R1 of curvature of the joining surface of the bent nib element 1*a* on the lower side sliding along the paper sheet, and hence the gap 20 is formed and the nib elements are dislocated relative to each other. Upon the appearance of the gap, the capillarity, i.e., the ink holding ability, of a portion of the nib corresponding to the gap 20 decreases, and ink held around the portion becomes able to flow easily toward the oblique tip portion 1*c*. During the ordinary use of the pen, writing force varies continuously and, consequently, the gap and the displacement vary continuously, whereby the nib exerts a pumping action.

Figure 9:
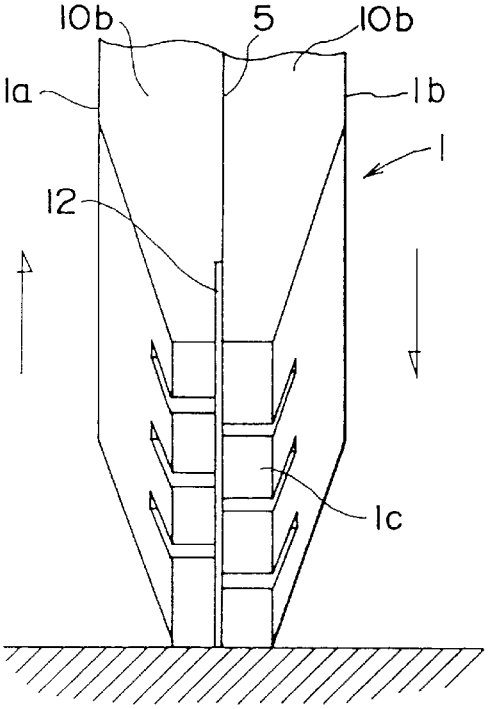
FIG. 9 is a view explanatory of a mode of drawing a thin line by using a surface of a tip portion of a nib.

FIG. 9 shows the nib in a state for drawing a thin line with the tip side surface 10*a* or 10*b*. When writing force is applied to the narrower edge of the tip portion 1*c*, the nib is not bent greatly and hence the bending of the nib cannot be utilized. However, when the nib is used for writing, a twisting force acts necessarily on the tip portion 1*c*. If a twisting force acts on the tip portion 1*c*, for example, an upward force acts on the nib element 1*a* and a downward force acts on the nib element 1*b*, and the nib elements 1*a* and 1*b* move slightly relative to each other in the directions of the arrows shown in FIG. 9, respectively. In this case, only a low ink driving force (i.e., a force that opens and closes the gap and causes the sliding and displacement of the nib elements) is produced. Accordingly, ink is supplied mostly through the joining surface slit 12. However, since the nib elements are bent slightly and slide relative to each other continuously, ink supplied into the ink passage is stirred by a pumping action resulting from the variation of capillarity and flows smoothly for writing.

A pen nib 1 according to a second embodiment of the present invention will be described with reference to FIGS. 10 to 12. The pen nib and an ink collector are formed separately. Therefore, the pen nib can easily be replaced with another nib suitable for drawing lines of a desired width or with a new one when the nib being used is worn out or broken.

The nib 1, similarly to the nib 1 in the first embodiment, consists of two nib elements 1*a* and 1*b*. As shown in a longitudinal sectional view in FIG. 10, the two nib elements 1*a* and 1*b* are put face to face and joined together, and the nib 1 is fixedly inserted in a feed tube 33 provided with comblike grooves 3, and the feed tube 33 is fitted in a neck tube 2. FIG. 11 shows the inner surface of the nib element 1*a* of the nib 1 in the second embodiment.

Figure 11:
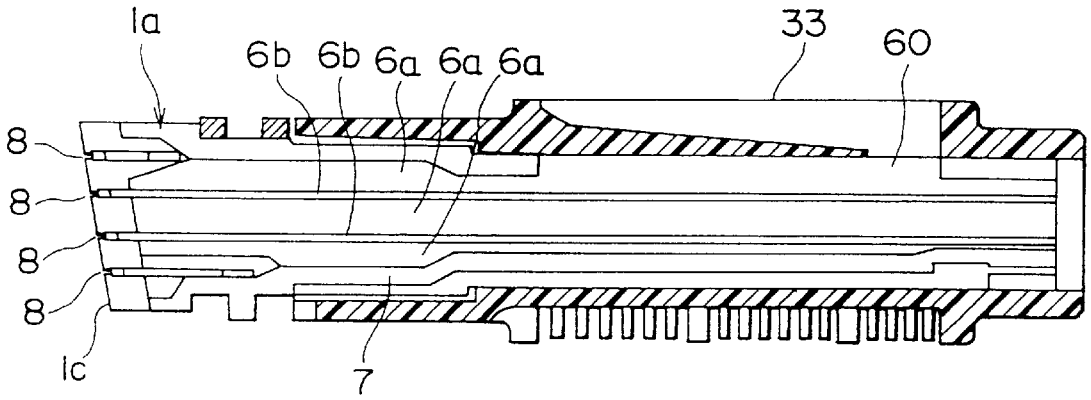
FIG. 11 is a side view of an inner surface of one of nib elements of the pen nib of FIG. 10.
Figure 12:
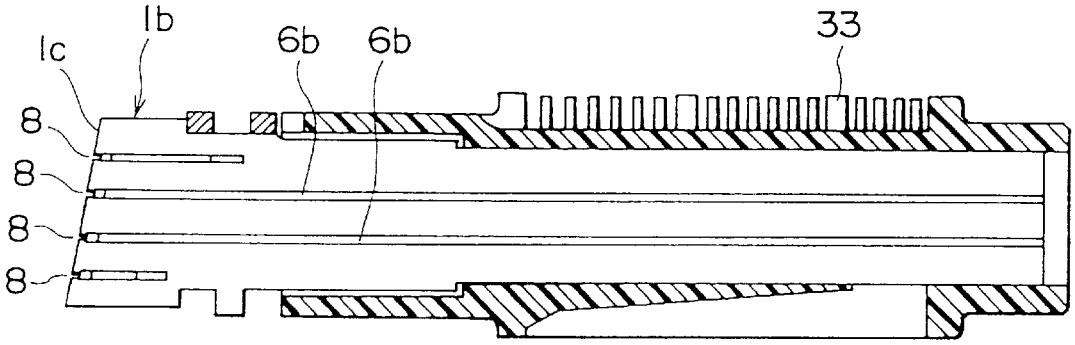
FIG. 12 is a side view of the inner surface of the other nib elements of the nib of FIG. 10.

Referring to FIG. 11, the nib element 1*a* is provided with an ink passage 6 having deep grooves 6*b* and a shallow groove 6*a* having the shape of a thin film. FIG. 12 shows the inner surface of the other nib element 1*b* of the nib 1. The nib element 1*b* is provided with only deep grooves 6*b* and is not provided with any groove corresponding to the shallow groove 6*a* having the shape of a thin film. Slits 8 are formed in both the nib elements 1*a* and 1*b*, and, if necessary, a joining surface slit 12 as shown in FIG. 4 is formed.

Figure 10:
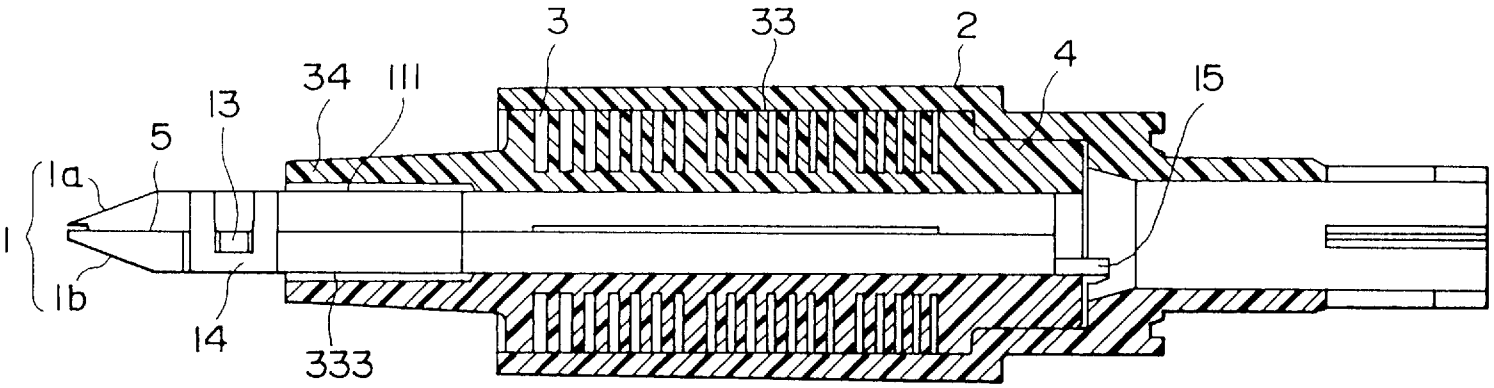
FIG. 10 is a longitudinal sectional view of a pen nib according to a second embodiment of the present invention as fixedly fitted in a feed tube fitted in a neck tube.

As shown in FIG. 10, a pair of projections 13 and a pair of catching members 14 are formed in opposing arrangement on each of the nib elements 1*a* and 1*b* to hold the nib elements 1*a* and 1*b* together. When the projections 13 are inserted in the catching members 14, a small gap capable of retaining an ink film is formed between the joining surfaces 5 of the nib elements 1*a* and 1*b*, or the nib elements 1*a* and 1*b* are joined together by such low pressure as to permit displacement of the nib elements 1*a* and 1*b* relative to each other when writing force is applied to the nib 1. Thus, the nib elements 1*a* and 1*b* are joined loosely together so that the nib 1 can be bent and the nib elements can be caused to slide relative to each other by writing force as mentioned above in connection with the first embodiment. Thus, the nib elements 1*a* and 1*b* are held together so that the bending of the nib elements 1*a* and 1*b*, and the movement of the nib elements 1*a* and 1*b* for sliding relative to each other by writing force may not be obstructed.

The nib elements 1*a* and 1*b* can be replaced with a nib having a different writing width. A nib suitable for drawing lines of a desired width can be used. If the nib elements 1*a* and 1*b* are worn out or broken, the used nib elements 1*a* and 1*b* can be replaced with new nib elements 1*a* and 1*b*. A portion of the nib element 1*b* on the side of an ink reservoir (not shown) is provided with a hook 15 which engages with a rear portion of the feed tube 33. The hook 15 is formed so that the hook 15 cannot be disengaged from the rear portion of the feed tube 33 by a force of 100 g or below to prevent the nib elements 1*a* and 1*b* from naturally falling off the feed tube 33. A front gap 333 is formed between the inner surface 34 of a front portion of the feed tube 33, and the outer surfaces 111 of the nib elements 1*a* and 1*b* to use the elasticity of the nib 1 effectively by enabling the nib 1 to be bent by writing force. Part of the gap 333 is used as an air inlet passage. If a portion of the nib 1 from the tip to a position near the front end of the feed tube 33 is immersed in ink and an ink sucking operation is performed, ink can efficiently be sucked without sucking a large quantity of air through the collectors 4.

The nib elements 1*a* and 1*b* may be held together by a method other than that described above. The nib elements 1*a* and 1*b* may be held together by a method in which a pin formed in the nib element 1*a* (or the nib element 1*b*) is inserted in a hole formed in the nib element 1*b* (or the nib element 1*a*) and the tip of the pin is deformed by ultrasonic machining. Another method may also be used in which projections (not shown) are formed on a portion of the outer surface of the nib 1 and/or a portion of the inner surface of the feed tube 33 in the gap 33 so that the nib elements 1*a* and 1*b* are loosely held together. A further method that may be used is to put rubberlike elastic members on the nib elements 1*a* and 1*b* or bury such members in the nib elements 1*a* and 1*b* to hold the nib elements 1*a* and 1*b* loosely together. A still further method is to use a material and form the front portion of the feed tube 33 in a shape so that the front portion of the feed tube 33 can elastically be deformed.

The structures and methods for loosely holding together the nib elements described in connection with the second embodiment are applicable to the first embodiment.

Figure 13:
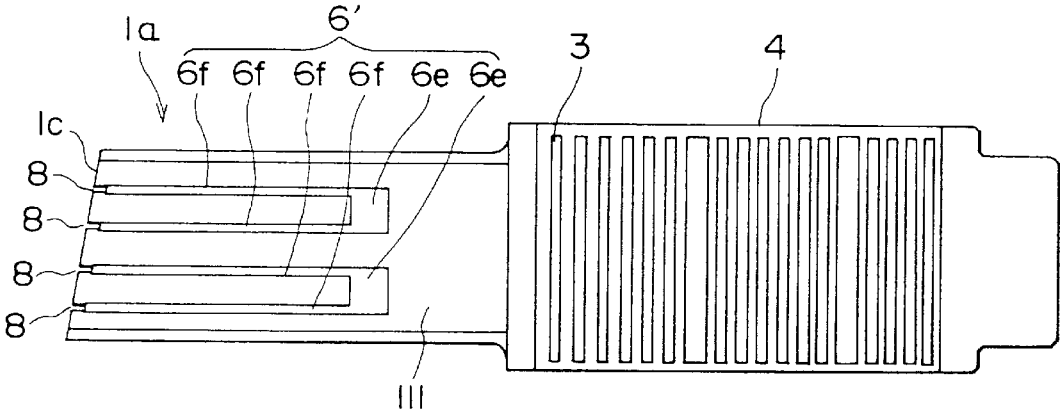
FIG. 13 is a side view showing an outer surface of a nib element of a pen nib according to a third embodiment of the present invention.

A pen nib according to a third embodiment of the present invention will be described with reference to FIGS. 13 and 14. In the third embodiment, a nib similar to those in the first and the second embodiment is provided with an ink passage in its outer surface, and the ink passage enables ink to flow into slits formed in the tip of the nib by capillarity.

The nib 1 in the third embodiment, similarly to the nib in the first embodiment, is fitted in a neck tube 2 (FIG. 1). FIG. 13 shows an outer side surface 111 of a nib element 1*a* included in the nib 1. Formed in the outer side surface 111 of the nib element 1*a* are ink pockets 6*e* and outer grooves 6*f* connected to the ink pockets 6*e*. The ink pockets 6*e* and the outer grooves 6*f* form a second ink passage 6'. Each outer groove 6*f* has one end connected to the ink pocket 6*e* and the other end connected to a slit 8 formed in the tip of the nib 1.

Figure 14:
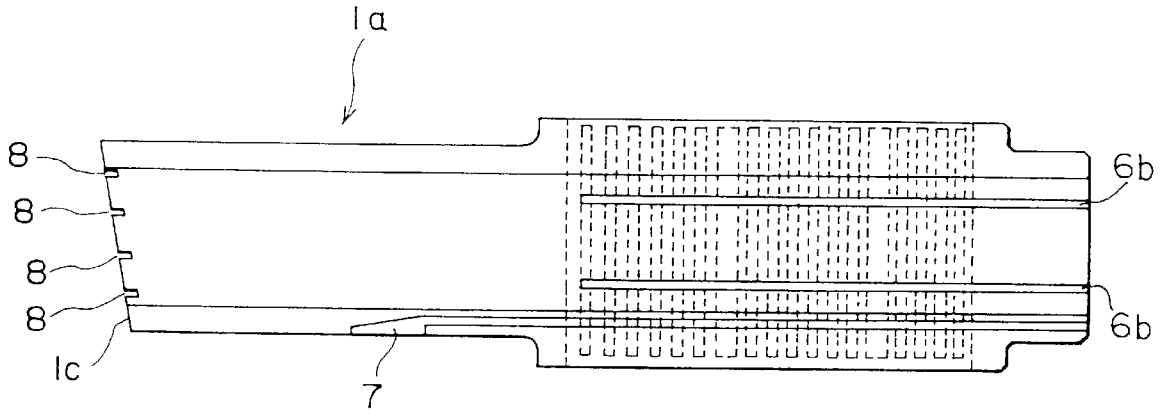
FIG. 14 is a side view showing the inner surface of the nib element of FIG. 13.

FIG. 14 shows an inner surface of the nib element 1*a*. In the first embodiment, ink contained in the ink reservoir (not shown) connected to the neck tube 2 flows through the shallow groove 6*a* having the shape of a thin film and the deep grooves 6*b* formed in the joining surface 5 of the nib 1, and is transferred via the slits 8 and the joining surface slit 12 to a paper sheet. In the third embodiment, ink supplied into the ink pockets 6*e* formed in the outer surface 111 of the nib 1 shown in FIG. 13, by a pipette or another writing implement flows through the outer grooves 6*f* to the slits 8 formed in the tip of the nib 1, and then the ink is transferred from the nib 1 to a paper sheet.

The operation of the third embodiment will be described below. The ink of a color supplied through the inside of the nib 1 and the ink of another color supplied to the outer side surface of the nib 1 are mixed at the tip portion 1*c*, so that complicated color variation can be enjoyed. Although the ink pockets 6*e* are not indispensable, it is desirable that the ink pockets 6*e* be formed, because it is somewhat difficult to pour ink of another color into the outer grooves 6*f* formed in the outer side surface of the nib elements 1*a* and 1*b*. The nib elements may be provided with a plurality of ink pockets 6*e*. If the plurality of ink pockets 6*e* and the outer grooves 6*f* connected to the ink pockets 6*e* are divided into groups, a plurality kinds of ink of different colors can be mixed at the tip portion 1*c* or a portion of writing on one side of the writing width can be marked in a mixed color by supplying, for example, blue ink from one of the groups, red ink from the other group and yellow ink from the pen barrel.

Since the nib elements 1*a* and 1*b* of the nib are not pressed against each other so strongly that any ink film cannot be formed by capillarity, an ink film is formed by capillarity in regions of the joining surfaces 5 not provided with the shallow groove 6*a* having the shape of a thin film, and the ink film is connected to the shallow groove 6*a* and the deep groove 6*b*, or the slits 8 and the joining surface slit 12. If ink of another color is supplied to the space between the joining surfaces 5 with a pipette or another writing implement, the ink of another color flows along the joining surfaces 5 into the ink passage 6 of the nib 5 and writing is marked in a mixed color. If the nib 1 is directed upward and ink of another color is supplied to the tip portion 1*c* of the nib 1, the ink of another color flows through the slits 8 and the joining surface slit 12, or the shallow groove 6*a* into the internal ink passage 6 of the nib 1, forcing the ink supplied from the ink reservoir (not shown) back into the ink reservoir. Consequently, the original ink held in a front portion of the nib 1 is replaced temporarily by the ink of another color. If the nib in this state is used for writing, first the ink of another color is transferred to a paper sheet, the ink of mixed color gradually changing from another color to the original color is transferred to the paper sheet, and, finally, the ink of the original color is transferred to the paper sheet, which brings about amusing color variation. Such capabilities of the nib provide color changing techniques very useful for calligraphy.

The pen nib of the present invention having the foregoing construction can be manufactured by a process which does not need any post-process, such as an injection molding process. The present invention provides an inexpensive, elastic pen nib capable of forming clear-cut. Since the two nib elements slide relative to each other when bent by writing force, dry residues of the ink come off the nib easily to enable the ink to flow smoothly, a large quantity of ink can be transferred to a paper sheet and troubles including insufficient flow of ink do not occur. The pen nib of the present invention is able to use ink having a high surface tension without a hitch. Further, the pen nib of the present invention is capable of drawing lines of two or more different widths.

INDUSTRIAL APPLICABILITY

The pen nib of the present invention is particularly useful for calligraphy owing to its capability of drawing lines of different widths and different colors, and can be mass-produced at low manufacturing cost.

What is claimed is:

1. A pen nib comprising a pair of nib elements each having a flat front portion having the shape of a flat plate, and a rear portion extending from the front portion; wherein the nib elements have flat inner surfaces serving as joining surfaces, respectively, the rear portions of the nib elements are fixedly joined together with their joining surfaces in surface contact with each other, and an ink passage is formed in at least one of opposite inner surfaces of the nib elements through the entire length of the inner surface corresponding to the front portion and the rear portion, wherein the ink passage includes a shallow groove of the shape of a thin film forming a gap which exercises capillarity between the nib elements, and deep grooves having a depth greater than that of the shallow groove and formed along and so as to be connected to the shallow groove, an end surface to be brought into contact with a paper sheet of each of the flat front portions of the pair of nib elements has long sides and short sides, and edges are formed along the long sides, and wherein slits connected to the ink passage are formed across the edges for supplying ink through the ink passage to the slits, whereby the flat front portions slide relative to each other for elastic deformation when writing force is applied to the tip of the nib for writing.

2. The pen nib according to claim 1, further comprising a holding means which determines a gap between the pair of nib elements so that the ink passage formed between the nib elements is not destroyed and does not obstruct the sliding displacement of the nib elements relative to each other.

3. The pen nib according to claim 2, further comprising an ink collector having comblike grooves for storing overflowing ink, said collector being formed in an outer surface of at least one of the pair of nib elements.

4. The pen nib according to claim 2, wherein the shallow groove having the shape of a thin film has a depth decreasing toward the tip of the nib.

5. The pen nib according to claim 2, wherein a joining surface slit substantially parallel to the joining surfaces is formed in an end surface of paper sheet contact portion of the front portion of the nib so as to be connected to the ink passage.

6. The pen nib according to claim 2, wherein the inner surface of at least one of the pair of nib elements is provided with connecting grooves connected to comblike grooves forming an ink collector for storing overflowing ink.

7. The pen nib according to claim 1, further comprising an ink collector having comblike grooves for storing overflowing ink, said collector being formed in an outer surface of at least one of the pair of nib elements.

8. The pen nib according to claim 7, wherein the shallow groove having the shape of a thin film has a depth decreasing toward the tip of the nib.

9. The pen nib according to claim 7, wherein a joining surface slit substantially parallel to the joining surfaces is formed in an end surface of paper sheet contact portion of the front portion of the nib so as to be connected to the ink passage.

10. The pen nib according to claim 7, wherein the inner surface of at least one of the pair of nib elements is provided with connecting grooves connected to comblike grooves forming an ink collector for storing overflowing ink.

11. The pen nib according to claim 1, wherein the shallow groove having the shape of a thin film has a depth decreasing toward the tip of the nib.

12. The pen nib according to claim 11, wherein a joining surface slit substantially parallel to the joining surfaces is formed in an end surface of paper sheet contact portion of the front portion of the nib so as to be connected to the ink passage.

13. The pen nib according to claim 11, wherein the inner surface of at least one of the pair of nib elements is provided with connecting grooves connected to comblike grooves forming an ink collector for storing overflowing ink.

14. The pen nib according to claim 1, wherein a joining surface slit substantially parallel to the joining surfaces is formed in an end surface of paper sheet contact portion of the front portion of the nib so as to be connected to the ink passage.

15. The pen nib according to claim 14, wherein the inner surface of at least one of the pair of nib elements is provided with connecting grooves connected to comblike grooves forming an ink collector for storing overflowing ink.

16. The pen nib according to claim 1, wherein the inner surface of at least one of the pair of nib elements is provided with connecting grooves connected to comblike grooves forming an ink collector for storing overflowing ink.

17. The pen nib according to claim 1, wherein the deep grooves formed in the inner surface of at least one of the nib elements and at least some of the slits are arranged asymmetrically with respect to the joining surface.

18. The pen nib according to claim 1, wherein the inner surface of at least one of the nib elements is provided with an auxiliary groove for ink at a position near the short side.

19. The pen nib according to claim 1, further comprising a second ink passage for exercising capillarity, said second ink passage being formed in the outer surface of the front portion of at least one of the nib elements so as to be connected to the slits.

20. The pen nib according to claim 1, wherein the number of the slits is greater than that of the deep groove, and ink is supplied to the slits not corresponding to the deep grooves through the shallow groove having the shape of a thin film.

* * * * *